United States Patent [19]

Weinfurth et al.

[11] Patent Number: 4,562,768

[45] Date of Patent: Jan. 7, 1986

[54] ALTERNATIVE AMMUNITION BELT FEEDER FOR AN AUTOMATIC MACHINE CANNON

[75] Inventors: Udo Weinfurth; Helmut Fischer; Walter Sauerwald, all of Duesseldorf, Fed. Rep. of Germany

[73] Assignee: Rheinmetall GmbH, Duesseldorf, Fed. Rep. of Germany

[21] Appl. No.: 588,126

[22] Filed: Mar. 9, 1984

[30] Foreign Application Priority Data

Mar. 11, 1983 [DE] Fed. Rep. of Germany ..... 3308676

[51] Int. Cl.[4] ..... F41D 10/38

[52] U.S. Cl. ..... 89/33.04; 89/33.4; 89/35.01

[58] Field of Search ..... 89/33.04, 33.4

[56] References Cited

U.S. PATENT DOCUMENTS 3,759,136 9/1973 Fammler ..... 89/33.4

*Primary Examiner*—Stephen C. Bentley

[57] ABSTRACT

An empty belt clip and empty cartridge casing discharge arrangement for use with a machine cannon which can, for example, be mounted in the gun turret of an armored vehicle. The arrangement includes a cradle and built-in gun barrel which is pivotally mounted in a gun mount about an axis which is parallel to the longitudinal axis of the gun barrel for control purposes. An alternate ammunition belt feeder is also pivotally mounted in the gun mount about a second axis which is also parallel to the longitudinal axis of the gun barrel and is adapted to assume an upper or lower operative position or a middle SAFETY position. The alternate ammunition belt feeder has an upper and lower outlet for empty belt clips. An upper and lower discharge duct are mounted in the arrangement so that their respective inlets confront the upper and lower outlets of the alternate ammunition belt feeder. A middle duct serves to receive the empty cartridge casings from the cradle. Means are respectively mounted in the inlet regions of the upper and lower discharge ducts to be actuated by the empty belt clips which are being discharged in dependence to the positional shift of the alternate ammunition belt feeder.

16 Claims, 14 Drawing Figures

ALTERNATIVE AMMUNITION BELT FEEDER FOR AN AUTOMATIC MACHINE CANNON

BACKGROUND OF THE INVENTION

An alternate ammunition belt support for an automatic machine cannon is described in U.S. Pat. No. 3,759,136. In this known arrangement the discharge ducts for empty cartridge belt clips remain stationary over their entire length while in operation relative to the alternate belt feeder. This also applies to the alternate cartridge belt feeder parts which are connected to the weapon. For this reason the discharge ducts must be detachably connected to the alternate cartridge belt feeder. The change from one to the other type of ammunition feed is effected by means of a special arrangement. Thus, by means of a rotational movement the belt carrying the non-elected type of ammunition is placed out of engagement with a feed sprocket wheel, and the belt with the selected ammunition is, in lieu of the previous belt, placed in engagement with the feed sprocket wheel. When transferring to a larger caliber range this operation requires the application of a considerable force which can cause malfunctioning. In addition thereto the alternate feed mechanism must be pivoted away from the gun barrel weapon in order to carry out certain control functions of the weapon in order to obtain access to and a working space for the weapon. This requirement in the known arrangement to provide connections between discharge ducts and the alternate feed mechanisms such that these connections may be detached and re-established is considered advantageous. The therewith connected work input and time consumption is also considered as excessive and therefore undesirable.

An alternate ammunition belt feed mechanism whose position is adjustable relative to the gun barrel and therefore also relative to the discharge ducts for changing the ammunition cannot be achieved with the known afore-described gun carriage.

SUMMARY OF THE INVENTION

It is an object of this invention to provide a movable-typesupport of the afore-described type for an automatic weapon, which has the two discharge ducts for an alternate belt feeder adjustably mounted and which provides a simplified access for controlling the automatic weapon. Moreover, the novel arrangement of this invention is less prone to malfunctioning and provides an increased availability with reduced spatial requirements.

The arrangement of the invention can be used for alternate ammunition belt feeders, in which the arrangement is transversely slidably displaceable relative to the longitudinal axis of the gun barrel, as well as such alternate cartridge belt feeders which are swingable about an axis which is parallel to the longitudinal gun barrel axis. The hereinafter described and illustrated embodiment of the invention belongs to the second type of alternate cartridge belt feeder of the afore-described two types of feeders. In the hereinafter described and illustrated embodiment there are described in particular detail an alternate ammunition belt feeder, the empty clips of which are connected to each other in a detachable manner and which belt exits in the form of a chain. However, the herein-following exemplary description also explains, without any difficulty, the applicability of the invention to an alternate cartridge belt feeder which is slidable transversely with respect to the longitudinal axis of the gun barrel as well as a cartridge belt that disintegrates and in which the empty belt clips leave the outlet of the alternate feeder in a detached condition.

BRIEF DESCRIPTION OF THE DRAWING

Other objects and advantages will become apparent in the following specification and considered in light of the attached drawings:

FIG. 1 shows a cross-hatched cradle member 23 in two positions which positions illustrate the manner of transporting empty belt clips of the alternate belts together with the feed-in region of the corresponding feed ducts;

DETAILED DESCRIPTION

Figure 1:
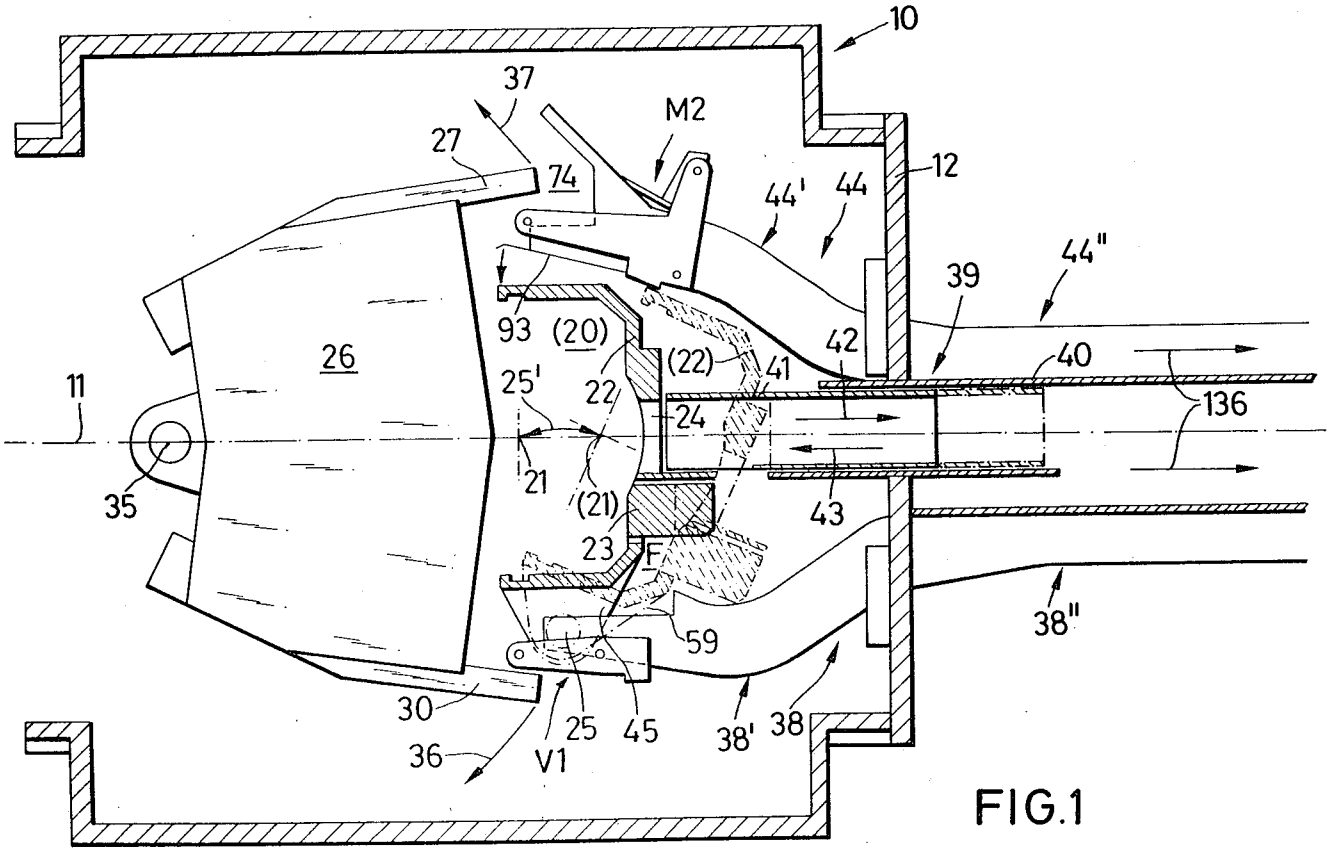
FIG. 1 is a schematic illustration of the arrangement of the invention shown in cross-section along a plane which is transverse with respect to the longitudinal axis of the weapon in which the alternate cartridge belt feeder is shown in a middle (neutral) position; the same

According to FIG. 1 there is movably mounted in a gun turret of an armored vehicle a gun mount 10 having a side wall 12 and a rotational axis 11. A gun barrel weapon 20, for example a machine cannon, is for purposes of clarity only illustrated by means of the penetration point of the gun barrel longitudinal axis 21 with the plane of the drawing of FIG. 1 and therefore the reference number 20 is set forth in parenthesis. The cradle 22 of the weapon has an outlet 24 for permitting the discharge of empty propellant charge casings. This outlet corresponds directly with a corresponding outlet at the gun barrel weapon 20. The cradle 22 is, jointly with the therein mounted gun barrel 20, pivotable in the direction of a double arrow 25' about a pivot 25, whose axis is parallel to the longitudinal gun barrel axis 21. The heavily cross-hatched portion of the cradle 22 corresponds to the operative position, whereas the lightly cross-hatched version corresponds to a control position. An alternate ammunition belt feeder 26 has an upper outlet 27 and a lower outlet 30 for empty belt clips 110. For purposes of change-over of ammunition to a different ammunition of the two types of ammunition which have been belted or for purposes of loading or unloading this alternate ammunition belt feeder 26 it can be positioned in a middle neutral "safety" position in the direction of two arrows 36, 37 by being pivoted about an axis 35. This axis 35 is parallel to the longitudinal gun barrel axis 21. There is arranged a feed duct 39 for coaction with the outlet 24 for discharging empty propellant charge casings. A duct member 41, which is proximate to the cradle 22, is journalled in a nonillustrated manner on the cradle 22 and is, in the direction of the arrows 42 and 43, telescopically mounted relative to the stationary member 40. The outlet 27 (30) is constructed so as to coact with the feed duct 44 (38) which duct includes a curved portion 44' (38') to which there is joined a straight portion 44" ( 38"). Both feed ducts 44, 38 are stationary relative to the mount 10 and side wall 12 and are arranged relative to each other in a mirror-symmetrical manner. The duct 39 is disposed between the two ducts 38 and 44. The alternate belt feeder 26 is illustrated in FIG. 1 in a middle, neutral or "safety" position. In this position there is no positive connection possible between a non-illustrated gas-pressure-loaded actuating piston and one of the two lateral feed drives. The arrangements of FIGS. 2*a* and 2*b* corresponds to that of FIG. 1. (In the hereinafter following description the letter a when used in conjunction with a reference number indicates the upper side and the letter b when used in conjunction with a reference number illustrates the lower side of the alternate belt feeder 26 and appurtenant parts.) For a better understanding of FIGS. 2*a* to 4*b* reference is made first of all to FIGS. 8, 7*a* and 7*b*.

Figure 8:
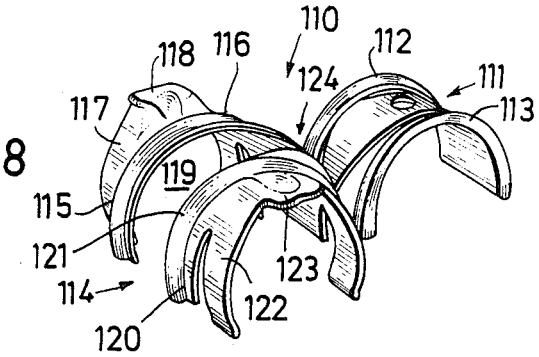
FIG. 8 is a perspective view of a single empty belt clip.

The empty cartridge belt double clip 110 illustrated in FIG. 8 includes a single claw 111 and a double claw 114 having two claw halves 115 and 120. The single claw 111 is of semicircular shape and is provided at both at its sides with a radially outwardly extending semi-circular flange 112, 113. Both halves 115, 120 of the double claw 114 are separated by means of a middle recess 119 from each other. To the left and right of the recess 119 there is provided a corresponding semi-circular shaped receiving channel 116, 121 for both semi-circular flanges 112, 113 of the single claw 111. At the exterior of the corresponding region of the receiving channels 116, 121 there is joined thereto a clamping part 117, 122, each of which has a guide nose 118, 123. A non-illustrated connection between the single claw 111 and the double claw 114 is arranged within a recess 124. For the detachable positive connection between two adjoining double belt clips 110 these are brought into a predetermined mutual angular position, so that the semi-circular flanges 112, 113 of the single claw 111 of a double belt clip can move into both receiving channels 116, 121 of the double claw 114 of the other adjoining double belt clip. When stretching the thus-formed two-double-belt-clip chain there results a positive connection between both belt clips. For detaching this positive connection both belt clips must again be pivoted towards each other and when separating can be lifted away or pulled away from each other.

Figure 7A:
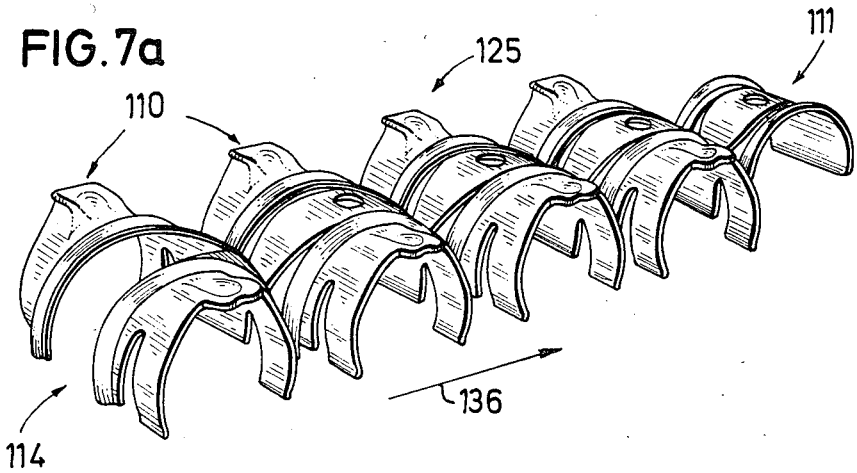
FIG. 7*a* and 7*b* are perspective views of a chain of empty belt clips.
Figure 7B:
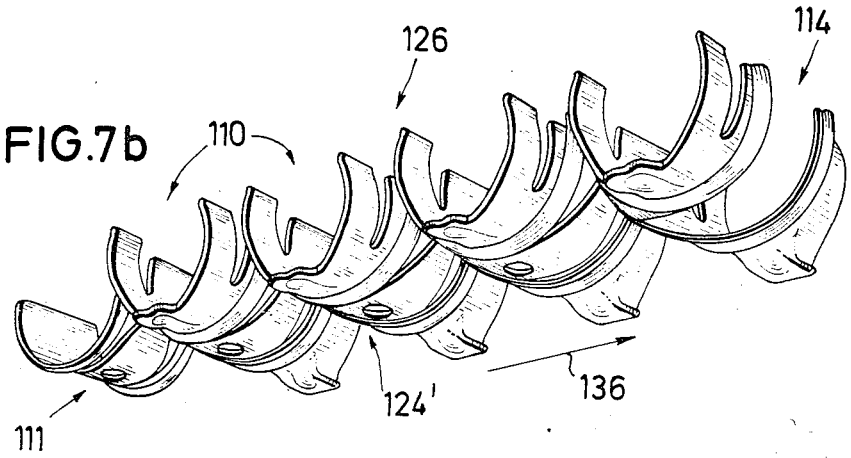

FIG. 7*a* (7*b*) illustrates a belt chain 125 (126) of empty and mutually positively connected belt clips 110 as assembled when they leave the outlet 27 (30) in the direction of one of the arrows 136. In the belt chain 125 the single claw 111 leads, whereas in the belt chain 126 the double claw 114 leads and forms part of the forward-most double belt clip 110. For purposes of clarification of the close connection there is illustrated at the side of the chain a recess 124' (FIG. 7*b*) (in conjunction with FIG. 8 the recess is designated 124).

Figure 2A:
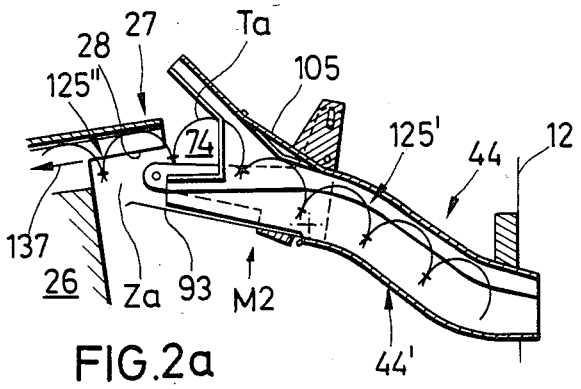
FIG. 2*a* and 2*b* illustrate the alternate belt feeder in a neutral position in accordance with FIG. 1.
Figure 2B:
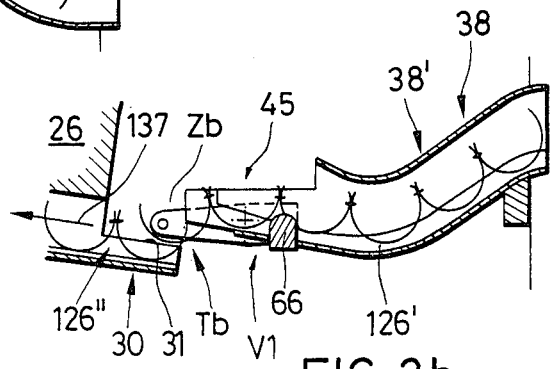
Figure 3A:
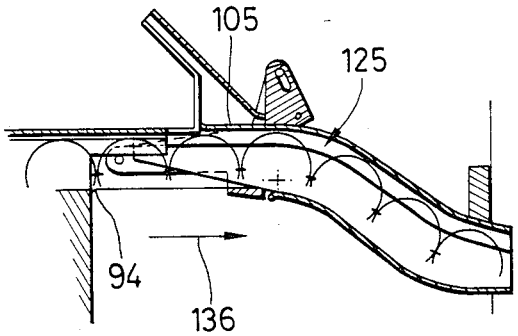
FIG. 3*a* and 3*b* illustrate that side of the alternate belt feeder which is illustrated in the upper portion of FIG. 1 and which is in an operative position for advancing of a first type of ammunition.
Figure 3B:
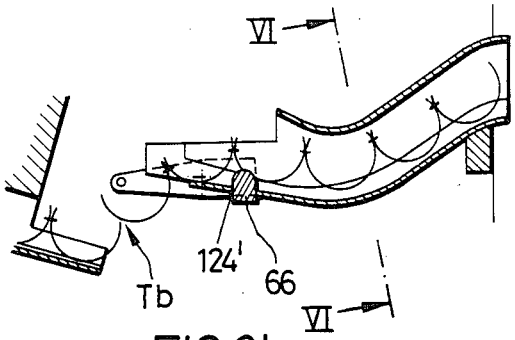

As can be viewed in FIGS. 2*a* and 2*b* there is disposed between the outlet 27 (30) at the alternate belt feeder 26 and a not further illustrated in detail end contour of the inlet region 74 (45) an intermediate chamber Za (Zb). This chamber is bridged over by a bent portion of the belt chain 125 (126). The function of this intermediate chamber will be described in detail hereinbelow. In the event a portion of the belt chain 125" (126") is pulled in the direction of the arrow 137 (for example during unloading of the alternate belt feeder 26), then, a result of the bending of the belt chain 125 (126), there is created without any problem a separating region Ta (Tb). However, the inlet region 74 (45) remains unchanged. A portion of the belt chain 125', (126'), in particular that belt clip 110 that forms the separating region Ta (Tb), remains fixed in a preponderantly defined manner. Thereby during the loading of the alternate belt feeder 26 the corresponding positive connection can again be reestablished. In this manner the arrangement can be very easily and simply manipulated. For a detailed description of the inlet regions 74 and 45 references is now being had to FIGS. 9*a* and 9*b*. According to FIG. 9*a* an upper cover 75 of the upper feed duct 44 ends at an upwardly directed enlargement 82 in the inlet region 74 which enlargement forms an end edge 76. In the inner chamber 79 there is arranged a guide ledge 80 which projects from each side wall 84 for guiding the guide noses 118 and 123 of the double belt clip 110 (see FIG. 8). Each guide ledge 80 ends at the inlet side of the duct 44 in an edge 80'. A guide member 81 confronts the inlet end of the guide ledge 80. Both side walls 84 end at corresponding end faces 85. Means M2 are provided at the inlet region 74. These means M2 encompass a first two-part angular lever 86 which has a first pair of lever arms 87 confronting the upper outlet 27 (FIGS. 2*a*, 3*a*, 4*a*) which includes a reflecting bolt 88 for coaction with the lower edge 28 of the upper outlet 27. The angular lever 86 includes a second pair of lever arms 89, both halves of which extend beyond the upper cover 75. In a manner not illustrated in detail the angular lever 86 is pivotable about an axis 90 of a shaft affixed in the side walls 84. The halves of the pair of lever arms 89 are connected to each other via a control axle 103. A second lever 99 is mounted between the two halves of the pair of lever arms 89. Each lever arm 101 of the second lever 99, which has of two halves, has a longitudinal aperture 104 for accommodating the control axle 103. A rotational axle 100 extends through a transverse strap 102. This strap joins the two halves of the pair of lever arms 101 to each other and forms a corresponding support shaft stump which is received in mating recesses in the two halves of the pair of lever arms 89. The transverse strap 102 supports at its lower side a sheet metal guide 105 having an upwardly bent lip 106 at its free end.

Figure 9A:
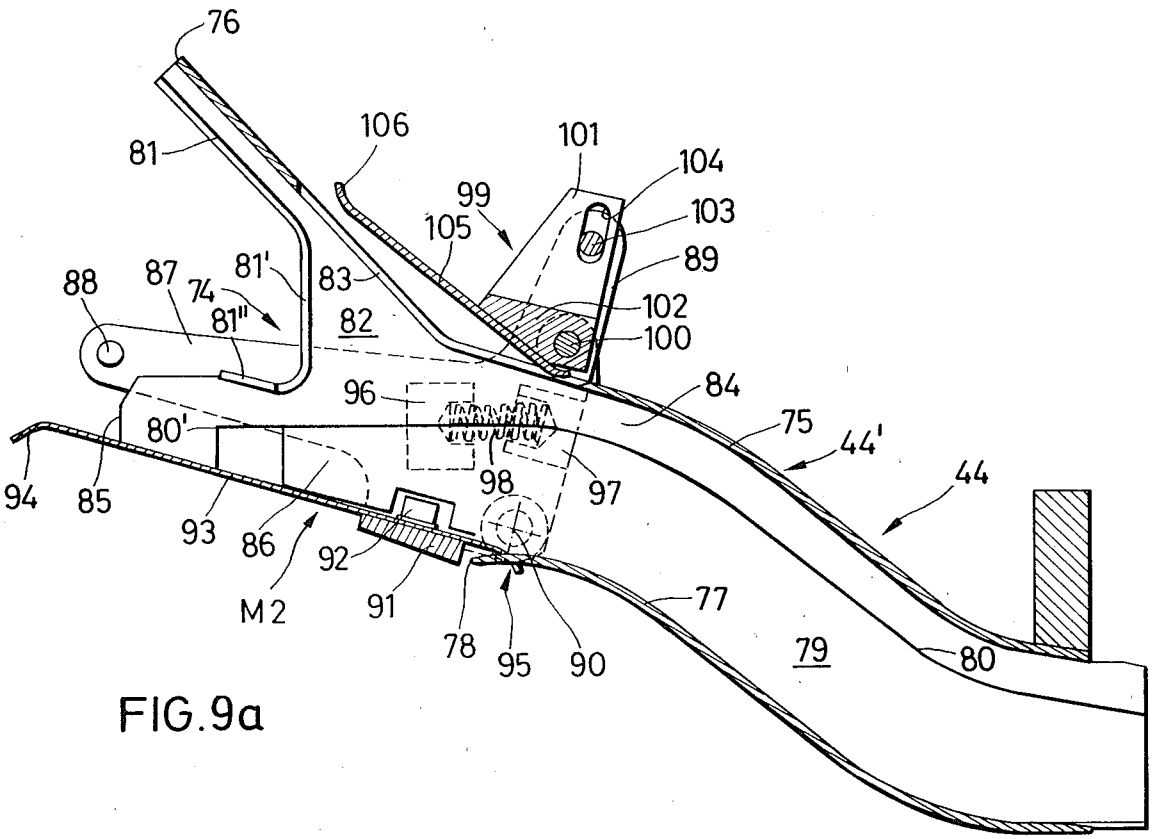
FIGS. 9*a* and 9*b* are side-elevational cross-sectional views of the respective inlet regions of the two feed ducts according to FIGS. 2*a* to 4*b* at an enlarged scale.

This sheet metal guide 105, in the position illustrated in FIG. 9*a*, is disposed above an opening 83 of the upper cover 75 in the region of the widened portion 82. A transverse strap 91 is arranged at the lower side of the angular lever 86. A sheet metal guide 93 is affixed by means of a screw 92 to the transverse strap 91. This sheet metal guide 93 has at its free end a bent down lip 94. At the other end the sheet metal guide abuts against the edge 78 of the bottom 77 at the connecting region 95. At each of both opposite side walls 84 there is mounted at the exterior side a first spring-biased abutment 96 for accommodating therein a coil spring 98. A further spring abutment 97 is connected at each one of the halves of the lever arm 89. By swinging the alternate belt feeder 26 in the clockwise direction (see FIG. 1) the lower edge 28 of the upper outlet 27 comes into contact with both deflecting bolts 88 on the lever arms 87. The angular lever 86 is then swung in the counterclockwise direction. The sheet metal guide 93 then abuts against the adjacent surface of the cradle 22 thereby protecting it and with its lip 94 against the adjoining surface of the alternate belt feeder 26. The coil spring 98 is then compressed. By virtue of the swinging motion of the angular lever 86 and its positive connection with the therein rotationally mounted second lever 99 a counterclockwise pivoting of the latter occurs. Thereby there also moves the sheet metal guide 105 through the opening 83 in the widened portion 82 and forms an extension of the upper cover 75 at the inlet side. In the afore-described position (FIG. 3*a*) the means M2 adapt themselves to the inlet region 74 of the upper outlet 27 and provide a flaw-free guide way for the empty belt double clip 110 in the direction of the arrow 136. For the situation in the region of the outlet 30 and the inlet region 45 reference is now being had to FIG. 3*b*.

Figure 9B:
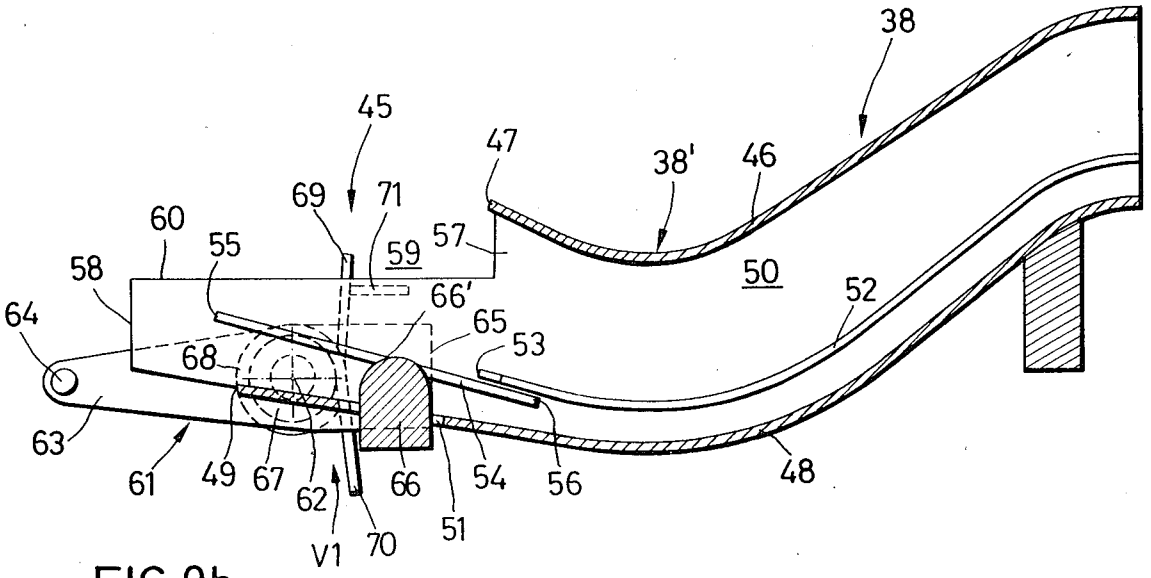

According to FIG. 9*b* there ends in the inlet region 45 an upwardly bent cover 46 with an inlet end edge 47. A bottom 48 ends at an inlet edge 49. An opening 51 is disposed in the bottom 48. Each side wall 57 of the duct 38 supports a guide ledge 52 which serves to guide the guide noses 118 and 123 of the belt clip 110. The inlet side the guide ledge 52 ends at an edge 53. An extension 54 of the guide ledge 52 extends from the lower side thereof between an inner end surface 56 and an outer end surface 55. An upper cut-out 59 provides a region 22' for the pivoted cradle 22 to form a chamber (see FIG. 1). An arrangement V1 includes a two-armed lever 61 consisting of two halves. This lever is pivotally mounted about a rotational axis 62 and is supported at the exterior of the side walls 57 in a manner not in detail illustrated. A first pair of lever arm 63 confronts the outlet 30 of the alternate belt feeder 26 and has at both of its halves an inwardly extending deflection bolt 64 for coaction with an upper edge 31 of the outlet 30 (see FIG. 2*b*). Both halves are joined by means of a second lever arm 65 of a holding element 66 having a semi-cylindrical upper surface 66'. A support 67 serves at both of the outer sides of the side walls 57 for receipt of a bending spring 68, one shank 70 of which bears against the holding element 66 and the other shank 69 of which abuts against the spring abutment 71 at the exterior side of the corresponding side wall 57.

Figure 4A:
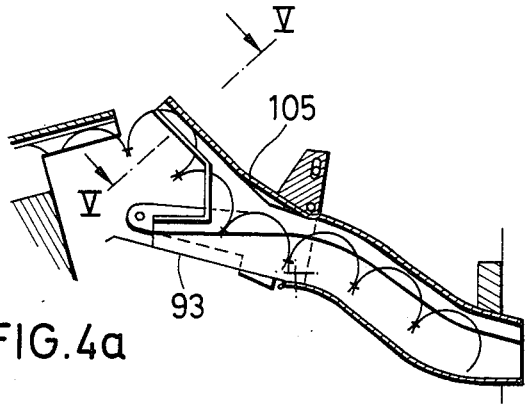
FIGS. 4*a* and 4*b* illustrate that side of the alternate belt feeder illustrated in FIG. 1 which is illustrated in the lower portion in an operative position for feeding the second type of ammunition.
Figure 4B:
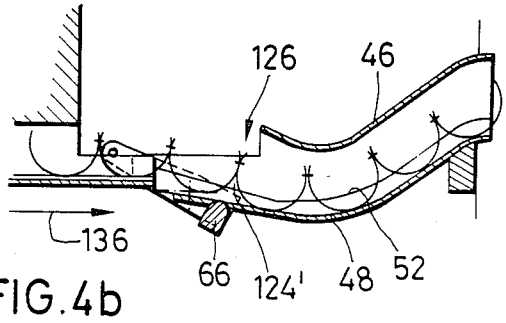
Figure 5:
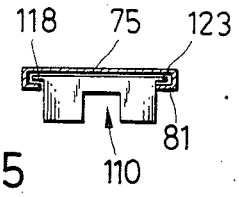
FIG. 5 is a cross-sectional view along lines V—V in FIG. 4*a;*
Figure 6:
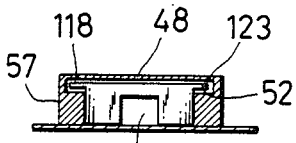
FIG. 6 is a cross-sectional view along line VI—VI in FIG. 3*b;*

When the alternate belt feeder 26 is swung in the counterclockwise direction for selecting an other type of ammunition (from the lower feed side), there results therefrom the operation illustrated in FIGS. 4*a* and 4*b*. The lower edge 28 of the outlet 27 releases both deflecting bolts 88 (see FIG. 4*a*), whereafter both angular levers 86 and 89 are pivoted by virtue of the action of the return spring force of the coil spring 98 in the clockwise direction. The means M2 assume in the inlet region 74 the position illustrated in FIGS. 4*a* and 9*a*. Then there occurs at the outlet 30 the following operation. The upper edge 31 arrives from below for contacting with both deflecting bolts 64 and pivots the lever 61 against the action of return spring force of the bending spring 68 in the clockwise direction. The holding element 66 moves through the opening in the bottom from the inner chamber 50 outwardly, the fixing of the belt clip 126 is released and thereby a flaw-free feeding away from the inlets of the duct of the next-following empty belt clip 110 joined to the belt chain 126'' and the belt clip chain 126' disposed in the feed duct 38 occurs. While the operation illustrated in FIG. 4*b* occurs the operation as illustrated in FIGS. 4*a* and 5 for the last empty belt clip 110 in the inlet region 74 of the feed duct 45 can be observed.

As has already been described in conjunction with FIGS. 2*a* and 2*b*, there is bridged-over from the paid out belt clip chain 125 (126) the gap between the outlet 27 (30) and the inlet region 74 (45) of the corresponding feed duct which gap is formed by the intermediate chamber Za (Zb). The belt clip 110 participating at the separation position Ta (Tb) is disposed by means of the mutual angular relationship and the preponderantly defined fixing in the inlet region 74 (45) in a position, which permits an effortless separation without any further manipulation. For this reason the invention can also be used for those gun mounts in which the alternate belt feeder is folded down relative to the gun barrel weapon for purposes of gaining access of control functions for the weapon. This is only possible without complex manipulation because the discharge ducts for the empty gun belt clips are not themselves detachably connected to the alternate belt feeder.

Both inlet regions 45 and 74 are funnel-shaped in such a way that also with a displacement of the corresponding outlets 30 or 27 relative to the inlet regions 45 or 74 the malfunction-free feed of the empty belt clips 110 is provided. The funnel-shape extends, at the inlet region 45, as well as on both side walls 57, as well as on the upper cover 46 and on the guide elements 54 relative to the bottom 48, and at the inlet region 74 again on both side walls 84, the bottom 77 for the upper cover 75 and the guide members 80 relative to the upper cover 75. The inner end surfaces 56 serve in the inlet region 45 as abutments for the corresponding guide noses 118, 123 when the holding element 66 is disposed in the illustrated position of FIGS. 2*b*, 3*b* and 9*b*. The guide members 81 (FIG. 9*a*) abut and guide the guide noses 118, and 123, as can be noted from FIGS. 2*a* and 2*b* for positioning the corresponding end belt clip 110.

When the gun mount in accordance with the invention is used and the alternate belt feeder 26 is moved, it must only be pulled out in the "safety" position illustrated in FIG. 1, counter to the firing direction, which is perpendicular with respect to the plane of the drawing, from its mount and pivoted about the swing axis 35. The inlet regions 74 and 45 and the belt clips 125' and 126' disposed in the ducts 44 and 38 remain advantageously completely unaffected by this. The reintroduction of the alternate belt feeder 26 into the firing direction is also quite simple. The completely flaw-free manipulation leads to an increased availability of the system; the spatial requirement is advantageously reduced.

The swinging of the cradle 22 together with the therein mounted gun barrel weapon 20 (for control purposes) about the axis 25, which is parallel to the gun barrel axis 21, renders the following advantages: The alternate belt feeder 26 and the feed ducts 44 and 38 remain unaffected and the gun barrel maintains its original direction. This leads to an increased safety which has been proven at firing ranges.

A pivoting of the cradle 22 with the therein built-in gun barrel 20 away and towards the regions 38' and 44' of the feed ducts 38 and 44 within a defined free space F can be adapted to the configuration of the regions 38' and 44' (this space is the first traversed by the telescoped portion 41 of the feed duct 39) (see FIG. 1) which adaptation is with respect to the contour of the cradle 22. This leads advantageously to a good spatial utilization providing a reduced spatial requirement.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved discharge arrangement for use with an automatic fire arm, in particular a machine cannon, having a gun mount in which an alternate ammunition belt feeder mechanism is operatively mounted, the improvement comprising the following features in combination, (a) said alternate ammunition belt feeder has two outlets for respectively discharging therethrough empty ammunition belt clips of two different types of ammunition, (b) said machine cannon has a cradle with a built-in gun barrel and a discharge opening for permitting the discharge of empty cartridge casings, (c) said arrangement having two discharge ducts, each duct is adapted to coact with one outlet of said two outlets of said alternate ammunition belt feeder to discharge empty belt clips therethrough;

(d) said two ducts are stationary over their entire lengths relative to said gun mount;

(e) a discharge duct having an inlet for empty cartridge casings, is mounted between said empty belt clips discharge ducts and confronts said inlet of said discharge duct for empty cartridge casings of said machine cannon;

(f) said alternate ammunition belt feeder is operatively movably mounted in said gun mount;

(g) said cradle together with the built-in gun barrel is operatively movably mounted relative to the gun mount for control purposes;

(h) means are operatively mounted in at least one of said two discharge ducts for holding empty belt clips therein;

(i) the upper one of said two discharge ducts has a first inlet region in which means are provided for positionally adapting said upper discharge duct in dependence to the position of said alternate ammunition belt feeder to receive empty belt clips therefrom; and (j) said holding means and adapting means are actuated in dependence to the positional shift of said alternate ammunition belt feeder.

2. The improvement in a discharge arrangement for use with an automatic fire arm as set forth in claim 1, wherein said two discharge ducts are mirror-symmetrically mounted in said gun mount.

3. The improvement in a discharge arrangement for use with an automatic fire arm as set forth in claim 2, including the following additional features:

(a) said cradle is pivotally mounted in said gun mount about an axis which is parallel to the longitudinal axis of the gun barrel; and (b) said discharge duct for empty cartridge casings includes two duct members which are telescopically mounted relative to each other.

4. The improvement in a discharge arrangement for use with an automatic fire arm as set forth in claim 3, wherein there is an intermediate gap between the upper outlet of the alternate ammunition belt feeder and the inlet of the upper discharge duct, said adapting means bridging over said gap.

5. The improvement in a discharge arrangement for use with an automatic fire arm as set forth in claim 4, wherein said adapting means are not connected to said alternate ammunition belt feeder.

6. The improvement in a discharge arrangement for use with an automatic fire arm as set forth in claim 5, wherein a guide element is operatively mounted in the inlet of each discharge duct for empty belt clips, said empty belt clips being detachably connected to each other and being respectively guided into said discharge ducts by said guide elements.

7. The improvement in a discharge arrangement for use with an automatic fire arm as set forth in claim 6, including the following additional features:

(a) each discharge duct for empty belt clips has a curved portion adjacent to its inlet;

(b) said curved portions are inclined towards each other and are adjoined by straight mutually parallel duct portions at the respective ends remote from said inlets thereof; and (c) said curved portions of said discharge ducts for empty belt clips defining a free space F therebetween, said cradle being pivotally movable into said free space F.

8. The improvement in a discharge arrangement for use with an automatic fire arm as set forth in claim 7, including a cutout region in the inlet of the lower discharge duct for empty belt clips into which a portion of said cradle can be pivoted.

9. The improvement in a discharge arrangement for use with an automatic fire arm as set forth in claim 8, wherein said alternate ammunition belt feeder and said two discharge ducts for empty belt clips are unaffected by a positional pivotal shift of the cradle and the built-in gun barrel.

10. The improvement in a discharge arrangement for use with an automatic fire arm as set forth in claim 9, wherein the inlets of the upper and lower discharge ducts for empty belt clips are funnel-shaped.

11. The improvement in a discharge arrangement for use with an automatic fire arm as set forth in claim 10, including the following additional features:

(a) said holding means is formed as a spring-biased two-armed lever;

(b) a first lever arm of said two-armed lever confronts the lower outlet of said two outlets of said alternate ammunition belt feeder and includes deflection bolt means for coaction with a projecting element mounted on said lower outlet;

(c) a second lever arm of said two-armed lever has a holding element;

(d) said two-armed lever is pivotally mounted at the inlet of the lower discharge duct of the two discharge ducts for discharging empty belt clips;

(e) a spring operatively connected to said two-armed lever so that when it is pivoted by said projecting element and counter to the return spring force of said spring the upper side of said holding element is moved to the level of the bottom of the lower discharge duct for discharging empty belt clips; and (f) when the first lever arm of said two-armed lever is released by said projecting element at said lower outlet the holding element moves through an opening in the bottom of the lower discharge duct for discharging empty clips into the interior space of said lower discharge duct.

12. The improvement in a discharge arrangement for use with an automatic fire arm as set forth in claim 11, including the following additional features:

(a) wherein said adapting means include two two-armed levers;

(b) the first of the two two-armed levers has a first and second arm and includes a spring operatively connected thereto and is pivotally mounted at the inlet of the upper discharge duct for discharging empty belt clips;

(c) the first arm of the first two-armed levers confronts the upper outlet of the two outlets of the alternate ammunition belt feeder and includes deflection bolt means for coaction with a projecting element mounted on said upper outlet;

(d) the second arm of the first two-armed lever extends with its free end past the upper cover of the upper discharge duct for empty belt clips and has a control pin laterally extending therefrom, the first arm of the second two-armed lever has a longitudinal slot into which said control pin extends, said second two-armed lever being pivotally mounted on said first two-armed lever;

(e) the second arm of the second two-armed lever confronts the upper outlet of the two outlets of the alternate ammunition belt feeder;

(f) said control pin and longitudinal slot coacting for positionally controlling said second arm of the second arm of the second two-armed lever;

(g) a sheet metal guide is mounted on the underside of the first arm of the first two-armed lever; and (h) when pivoting the first two-armed lever by means of contact by the upper outlet of the two outlets of the alternate ammunition belt feeder against the force of said spring, the second arm of the second two-armed lever traverses an opening in the upper cover of the upper discharge duct for discharging empty belt clips and the sheet metal guide abuts against the alternate ammunition belt feeder.

13. The improvement is a discharge arrangement for use with an automatic fire arm as set forth in claim 12, including the following additional feature:

the second arm of the second two-armed lever is made of sheet metal.

14. The improvement in a discharge arrangement for use with an automatic fire arm as set forth in claim 13, wherein the sheet metal guide is in the form of a springy sheet metal and has a downwardly bent lip at its free end.

15. The improvement in a discharge arrangement for use with an automatic fire arm as set forth in claim 14, wherein said upper cover of the upper discharge duct for empty belt clips in the region which confronts the upper outlet of the alternate ammunition belt feeder is bent upwardly and a guide element is mounted on the side walls of said confronting region for guiding guide noses of empty belt clips into the upper discharge duct for empty belt clips.

16. The improvement in a discharge arrangement for use with an automatic fire arm as set forth in claim 15, including a guide ledge mounted on the side wall of the upper discharge duct for empty belt clips for coacting with said guide element.

* * * * *